United States Patent [19]

Anderson

[11] 4,092,073

[45] May 30, 1978

[54] WRITING INSTRUMENT WITH BAYONET LOCK

[75] Inventor: Olof Verner Anderson, North Kingstown, R.I.

[73] Assignee: Anson Incorporated, Providence, R.I.

[21] Appl. No.: 742,005

[22] Filed: Nov. 15, 1976

[51] Int. Cl.[2] ..... B43K 7/00

[52] U.S. Cl. ..... 401/209

[58] Field of Search ..... 401/213, 99, 102, 108, 401/109, 112, 117, 54, 208, 209, 81

[56] References Cited

U.S. PATENT DOCUMENTS

| | | | |
|---|---|---|---|
| 2,783,741 | 3/1957 | Maczynski | 401/112 |
| 3,458,267 | 7/1969 | Larson | 401/213 |
| 3,801,206 | 4/1974 | Poritz | 401/112 X |

FOREIGN PATENT DOCUMENTS

| | | | |
|---|---|---|---|
| 29,273 | 4/1884 | Germany | 401/109 |

*Primary Examiner*—Stephen C. Pellegrino

*Attorney, Agent, or Firm*—William Frederick Werner

[57] ABSTRACT

The present disclosure relates to writing instruments comprising several removable parts and specifically to a construction wherein the several parts are firmly held together during the writing operation, yet may be quickly and easily disassembled to replace the ink cartridge.

2 Claims, 5 Drawing Figures

WRITING INSTRUMENT WITH BAYONET LOCK

STATEMENT OF INVENTION

The present invention relates to a novel construction in a writing instrument and more particularly to a telescopic bayonet joint between the barrel sleeve and cap, housing the ink cartridge.

BACKGROUND OF THE INVENTION

In the past, writing instruments termed fountain pens comprised a hollow barrel housing a flexible well which acted as a plunger to draw liquid ink into the well. The ink was dispensed through a nib. A cover was removably attached to the barrel to cover the nib when the pen was not in use.

The fountain pen was replaced by a ball point pen having a writing point in the form of a ball, fed with a rather viscous ink from a cartridge-type reservoir. A propel-repel type mechanism was employed to draw the writing point into and out of the barrel of the writing instrument.

Recent developments in liquid ink cartridges has permitted fiber tips to be attached to the writing ends of ink cartridges. The problem presented is to provide a barrel construction wherein the ink cartridge may be securely housed, be ready for instant use, protect the fiber tip against accidental use, reduce ink evaporation to a minimum and provide easy and rapid means for replacing the ink cartridge.

OBJECTS OF THE INVENTION

It is therefore an object of the present invention to provide a barrel construction wherein an ink cartridge is securely housed and quickly and easily replaced.

Other objects of the present invention will become apparent in part and be pointed out in part in the following specification and claims.

BRIEF DESCRIPTION OF THE DRAWINGS

Like reference numerals refer to like parts in the following drawings in which.

DESCRIPTION OF THE PREFERRED EMBODIMENT

Figure 2:
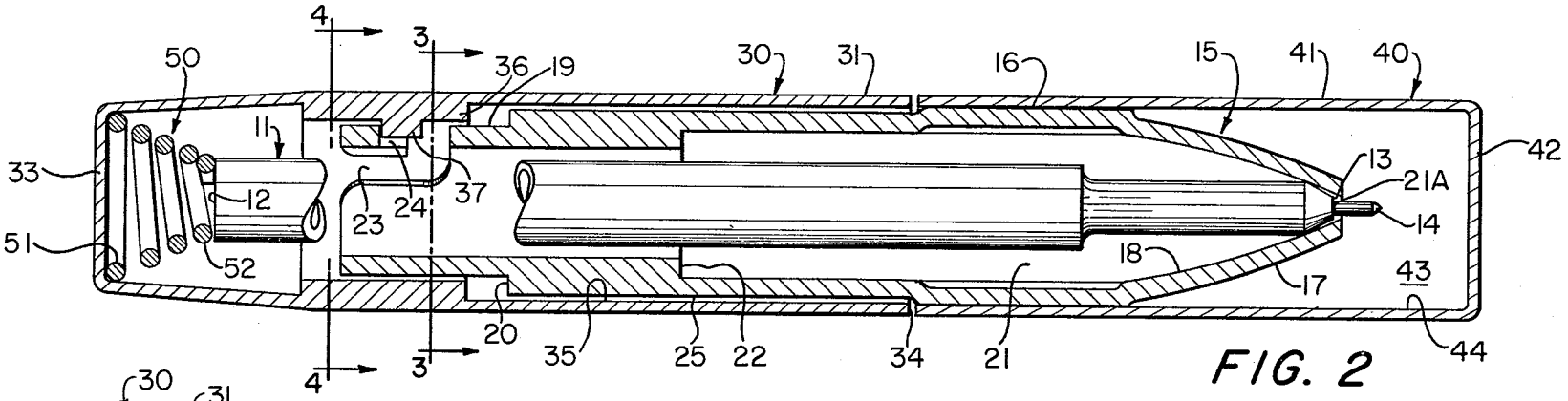
FIG. 2 is a medial cross-sectional view of the assembled new barrel construction.
Figure 1:
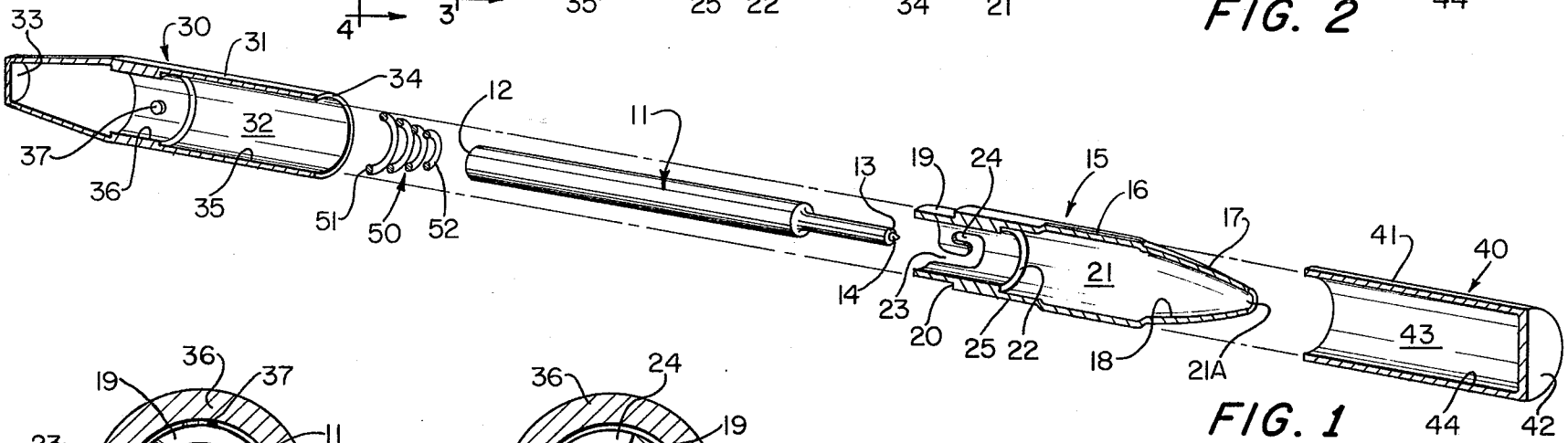
FIG. 1 is an exploded perspective view, partly in medial cross section, showing the new barrel construction.
Figure 5:
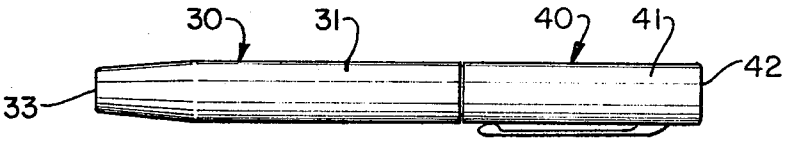
FIG. 5 is a side elevational view of the new writing instrument with a bayonet lock.
Figure 3:
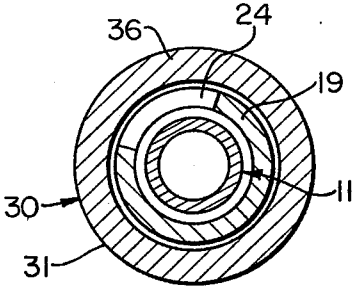
FIG. 3 is a vertical cross sectional view, taken on line 3—3 of FIG. 2, looking in the direction of the arrows.
Figure 4:
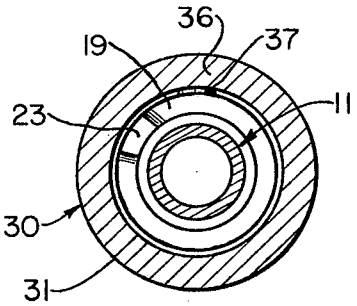
FIG. 4 is a vertical cross sectional view, taken on line 4—4 of FIG. 2, looking in the direction of the arrows.

In all conventional writing implements of the types commonly referred to as ball point pens and fiber tip pens, the pens comprise ink supply reservoirs or cartridges, generally indicated at 11, containing writing fluid. Ball point pens use a viscous writing fluid. Fiber tip pens have a tip made from a fiber, such as felt or nylon, and a sponge-type reservoir for absorbing and retaining a readily flowable writing fluid.

Cartridge 11 is provided with an inboard end 12, and a writing end 14. The writing end or tip 14 may be provided with a shoulder 13.

A sleeve, generally indicated at 15, comprises a body wall 25 having an outer surface 16 and an inner surface 18 which forms an axial passageway 21. Said outer surface 16 is formed into a tapered end or nose cone 17 on one end and is provided with a step 20 and a reduced diameter or rim 19 on the other end. Axial passageway 21 becomes a small opening 21A as it passes through the end of nose cone 17. Body wall 25 may be provided with an increased thickness to increase the strength of wall 25, thereby forming a ridge 22 in axial passageway 21. A bayonet slot 23, 24 is provided in body wall 25.

A hollow cap, generally indicated at 30 is provided with an outer surface 31, and an inner wall 35 which forms a chamber 32 closed on one end by a back wall 33. Inner wall 35 may be reinforced by a flange 36. A projection 37 protrudes from inner wall 35 and flange 36 when a flange is deemed necessary. For identification, the open end of hollow cap 30 is termed end wall 34.

A cover, generally indicated at 40, comprises a hollow tube body 41 closed on one end by a partition 42 to form a cavity 43. Body 41 provides an internal surface 44.

In assembling the writing instrument, the ink cartridge 11 is partially inserted within sleeve 15 with shoulder 13 abutting the inner surface 18 of nose cone 17 and the writing tip 14 passing through and beyond opening 21A, so as to expose the writing tip 14 to the atmosphere.

The cartridge 11 is of a length, as to extend beyond the end of the sleeve opposite the nose cone 17. A coil spring, generally indicated at 50, having a large end 51 and a small end 52, is inserted into chamber 32 with the large end 51 against back wall 33. Cap 30 is then placed over ink cartridge 11 so as to locate the exposed end of the ink cartridge 11 within chamber 32 and with the inboard end 12 against the other small end 52 of coil spring 50. Manual pressure is now applied to cap 30, while sleeve 15 is held firm, whereby spring 50 forces shoulder 13 against inner surface 18 and with inner wall 35 slidably and oscillatingly engaging rim 19, whereby projection 37 enters bayonet slot 23 and is rotated into position in slot 24 where projection 37 becomes spring locked. In this manner, a new writing instrument barrel construction is provided.

The writing instrument is now in condition to be used for the purpose intended. It will be noted that pressure on the writing tip 14 is opposed by the pressure in coil spring 50. It will also be noted that sleeve 15 held firmly, will permit cap 30 to be forced, against the pressure in spring 50, toward sleeve 15 to slide projection 37 along slot 24. With a twist of cap 30, projection 37 will move into slot 23 so as to be withdrawn therefrom, for the separation of cap 30 from sleeve 15 and the replacement of ink cartridge 11.

It will be further noted that a telescopic bayonet joint is provided for the uniting of the cap 30 with sleeve 15. Spring pressure repels the cap 30 from the sleeve 15.

It is necessary to provide a cover over tip 14 to prevent evaporation of ink and to prevent the ink in tip 14 from spoiling the clothing which contacts the tip. To that end, cover 40, surface 44, is slidably mounted upon outer surface 16, with a press fit gripping action, to removably secure the cover 40 to sleeve 15. Nose cone 17 and tip 14 are then located in cavity 43.

It is obvious that the gripping engagement of inner surface 44 with outer surface 16 must be firm to prevent accidental separation. Let it be assumed that the telescopic bayonet lock is dispensed with. Inner wall 35 gripping pressure engages rim 19 and internal surface 44 gripping pressure engages collar 16. To extract cover 40 from sleeve 15 results in a conflict of gripping forces. Therefore, either the cap 30 or the cover 40 must be mechanically removably detached to sleeve 15 to provide a workable connection between the several parts.

What I claim is:

1. A writing instrument consisting of an ink cartridge having an inboard end and a writing end, a sleeve comprising a body wall having an outer surface, and an axial passageway, a bayonet slot in said body wall, said ink cartridge partially located in said axial passageway with said writing end projecting beyond said body wall, a hollow cap provided with an inner wall forming a chamber closed on one end by a back wall, a projection in said inner wall, said inner wall slidably engaging said outer surface with said cartridge partially located in said chamber, spring means interposed between said back wall and said inboard end (,) to provide resilient pressure on said writing end in writing position, means retaining said ink cartridge in said axial passageway under pressure of said spring means, said projection slidably engaging said bayonet slot under pressure from said spring means, and a cover having an inner surface providing a cavity, said inner surface slidably engaging said outer surface, to locate said writing point within said cavity.

2. A writing instrument consisting of an ink cartridge having an inboard end, a shoulder and a writing tip, a sleeve comprises a body wall having an outer surface, a nose cone on one end of said outer surface, a rim on the other side of said outer surface, a step separating said rim from said outer surface, said sleeve having an axial passageway with an opening in said nose cone, a bayonet slot in said body wall, a hollow cap provided with an outer surface, a chamber closed on one end by a back wall, an end wall, and an inner wall having a flange, a projection in said flange, a cover comprising a hollow tube body, having an internal surface, a partition closing said hollow tube body on one end to form a cavity, said ink cartridge being partially located in said sleeve with said shoulder abutting said inner surface, and with said writing tip projecting through said opening, a coil spring located in said chamber with one end against said back wall, said inner wall slidably engaging said rim with the other end of said spring engaging said inboard end (,) to provide resilient pressure on said writing end in writing position, and said projection slidably engaging said bayonet slot under the pressure of said coil spring, with said spring pressure repelling said cap from said sleeve through said ink cartridge, and said cavity located over said nose cone with said inner surface slidably engaging said collar.

* * * * *